US010208476B2

(12) United States Patent
Van Rijsingen

(10) Patent No.: US 10,208,476 B2
(45) Date of Patent: Feb. 19, 2019

(54) FOLDABLE STRUCTURAL PLATE ELEMENT

(71) Applicant: Ripstaal B.V., Oss (NL)

(72) Inventor: Wilhelmus Mathias Maria Van Rijsingen, Oirschot (NL)

(73) Assignee: Ripstaal B.V., Oss (NL)

( * ) Notice: Subject to any disclaimer, the term of this patent is extended or adjusted under 35 U.S.C. 154(b) by 527 days.

(21) Appl. No.: 14/783,910

(22) PCT Filed: Apr. 15, 2014

(86) PCT No.: PCT/NL2014/000015

§ 371 (c)(1),
(2) Date: Oct. 12, 2015

(87) PCT Pub. No.: WO2014/171817

PCT Pub. Date: Oct. 23, 2014

(65) Prior Publication Data

US 2016/0053484 A1 Feb. 25, 2016

(30) Foreign Application Priority Data

Apr. 15, 2013 (NL) ..... 1040162
Nov. 4, 2013 (NL) ..... 1040481

(51) Int. Cl.
*E04B 2/72* (2006.01)
*E04F 19/06* (2006.01)
*E04C 2/32* (2006.01)

(52) U.S. Cl.
CPC ..... *E04B 2/721* (2013.01); *E04B 2/723* (2013.01); *E04C 2/328* (2013.01); *E04F 19/062* (2013.01);
(Continued)

(58) Field of Classification Search
CPC ..... E04C 2/328; E04F 19/064; E04F 19/062; Y10T 29/49876; Y10T 29/49629;
(Continued)

(56) References Cited

U.S. PATENT DOCUMENTS 6,088,967 A * 7/2000 Johnson ..... F21V 3/00 362/145
8,236,114 B2 8/2012 Gangl

FOREIGN PATENT DOCUMENTS

CN 1954125 A 4/2007
CN 202644722 U 1/2013
(Continued)

*Primary Examiner* — Sarang Afzali
(74) *Attorney, Agent, or Firm* — Gable Gotwals

(57) ABSTRACT

A method for the manufacture of a foldable building plate element by providing a flat plate (1), providing of at least one folding groove (2) in the flat plate, providing a folding profile (6), comprising two side wings (7) and an interposed folding portion (8), and fitting the folding groove into the folding profile in such a way, for example by gluing, that the side wings thereof form a strong connection with the two side faces (5) of the folding groove. The side wings are interconnected with each other through a bridging strip (9), which will be removed when the plate is folded. The wings are further provided with connecting means (10) that snap-connect with each other when the side wings are folded towards each other. If desired, a filler strip (11) can be inserted between the side wings.

2 Claims, 4 Drawing Sheets

(52) U.S. Cl.
CPC ..... *E04F 19/064* (2013.01); *E04B 2002/725* (2013.01)

(58) Field of Classification Search
CPC ..... Y10T 403/32311; Y10T 403/32262; Y10T 403/32254; E04B 2/721; E04B 2/723; E04B 2002/725
USPC ..... 52/631, 71, 844
See application file for complete search history.

(56) References Cited

FOREIGN PATENT DOCUMENTS

| | | | |
|---|---|---|---|
| DE | 3138380 | A1 | 4/1983 |
| DE | 3141709 | A1 | 5/1983 |
| DE | 29715787 | U1 | 10/1997 |
| DE | 29910878 | A1 | 9/1999 |
| DE | 10241223 | A1 | 4/2004 |
| GB | 1570761 | A | 7/1980 |
| JP | 2000129839 | A | 5/2000 |
| KR | 200413685 | Y1 | 4/2006 |
| WO | WO 2008/012854 | A1 | 1/2008 |

* cited by examiner

FOLDABLE STRUCTURAL PLATE ELEMENT

CROSS-REFERENCE TO RELATED APPLICATIONS

This application is the United States National Phase of Patent Application No. PCT/NL2014/000015 filed 15 Apr. 2014, which claims priority to Netherlands Patent Application Nos. 1040162 filed 15 Apr. 2013 and U.S. Pat. No. 1,040,481 filed 4 Nov. 2013, each of which is incorporated herein by reference.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable

INCORPORATION BY-REFERENCE OF MATERIAL SUBMITTED ON A COMPACT DISC

Not Applicable

BACKGROUND OF THE INVENTION

The invention relates to a foldable structural (building) plate element, including a method for the manufacture thereof and a building plate element comprising the profile.

If a flat plate is used in building construction, for example for covering of a wall which contains parts which are not located in the same plane, for example which extend forward or backward, the plate (gypsum board, or other plate) is sawn and cut out at 45°, and the two parts are then glued to each other in order to create a corner (forwards or backwards).

BRIEF SUMMARY OF THE INVENTION

Object of the present invention is to provide a method, which enables production of foldable building plate elements in a factory instead of at the construction site; wherein the plate members—entirely sized beforehand—can be transported in a flat state to the construction site concerned, and there be folded down during their installation. Further object of the invention is to provide for that the production—in the factory—is performed under better-controlled conditions than customary at the construction site. Object of the invention is thereby to contribute to the quality of the respective building elements and also to the reduction of the production and installation time. Additionally, as will apparent hereinafter, a building element is obtained which has a tighter angle finish and which moreover is less susceptible to damage. Therefore with the invention, applying edge protectors (edge corners/profiles/sections) to prevent damaging of protruding corners is no longer necessary prior to plastering.

The invention therefore comprises a method for producing a foldable building plate element, comprising the steps of:

providing a flat plate (with predetermined properties and dimensions);

providing of at least one (e.g., V- or U-shaped) folding groove in the flat plate (preferably, a groove is provided which leaves a flexible topcoat intact, such as a cardboard layer with a gypsum board, or a plastic topcoat/sheathing with a chipboard);

providing a folding profile, for example made of plastic or metal, comprising two side wings and a folded portion interposed there between, in cross-sectional view;

fitting the folding profile into folding groove in such a way, that the side wings thereof form a strong connection with both sides faces of the folding groove and/or with the zones of the flat plate adjacently located to the folding groove. Preferably, the side wings are glued against the sides faces (or at least partially) of the folding groove.

In order to be able to provide that the folding profile is easy to handle during transport (during which the folding profile is still in a flat state) and does not undesirable fold, preferably, the (open) side wings of the folding profile are interconnected by means of a pull-off or otherwise removable bridging strip (or locking strip) that in particular is pulled off immediately prior to the folding of the plate, or is removed in some other way (e.g., cut loose) from the space between the two (open) side wings, where after the plate can be folded by means of the folding profile (which is released or in other words "unlocked" by removal of the bridging strip, and thus becomes foldable).

Preferably, the side wings of the profile are provided with connecting means, which are arranged to detachably interconnect with each other when the side wings are folded towards each another (i.e., in their closed position). In this way, the building element is provided with increased rigidity after the parts of the flat plate are folded towards each other.

The connecting means are preferably mutually snap-connectable ("clickable") when the side wings are folded (closed) toward each other. The same (preferably "clickable") connecting means can also be used for the bridging/locking strip, which is intended—in the locked position—to maintain the folding profile in its open position during transport and storage (i.e., prior to the folding of the plate element), by connecting its side ends ("clickable/detachable") to the (inside of the) side wings of the folding profile. Unlocking of the folding profile, prior to the folding of the plate element, and subsequently folding over of the plate member and thereby at the same time folding up the folding profile, can then be carried out by firstly pulling off the bridging strip from (the connecting means of) the (open) folding profile, which holds the wings at a distance from each other.

After the plate member is folded over, in which the side wings move towards each other, the side wings are ("clickable") interconnected and are held in the closed position ("locked"), using the same ("clickable") connecting means which previously ensured that the bridging/locking strip could hold the side wings locked in their open position.

Seen in cross-sectional view, the opening angle of the folding groove generally is 90°, when the angle between the plate parts is 90°. However, this angle may also be larger or smaller than 90°.

In order to provide that the opening angle of the folding groove is not directly dependent on the mutual angle between the plate members, a filler strip may be provided, which is arranged to be fitted between the side wings of the folding profile. Preferably, the filler strip and the side wings of the folding profile are provided with connecting means, which are arranged to detachably interconnect with each other, when the side wings and the spacer strip are folded towards each other. The connecting means are preferably mutually snap-connectable ("clickable") when the side wings and the spacer strip are folded towards each other.

Method for mounting a building plate element manufactured according to any one of the preceding claims, comprising the steps of providing a building plate element manufactured as described hereinbefore;

folding (optionally after removing/pulling-off/snapping-loose of the bridging/locking strip) the flat plate into the desired shape by means of the folding profile or the folding profiles.

If desired, as is already mentioned, a filler strip may be provided between the side wings of the folding profile. When a bridging strip is present across the side wings of the folding profile, firstly this bridging strip must be removed before being able to fold the plate element.

The invention also comprises a profile, arranged to be used as a folding profile in a method or as a building plate element as mentioned previously. In cross-sectional view, the profile comprises two side wings and an interposed folding portion, wherein the side wings are arranged to be able to form a strong connection with both side faces of the folding groove and/or with the zones of the flat plate that are located adjacent to the folding groove. Preferably the side wings of the folding profile are interconnected with each other or can be connected by means of a pull-off or otherwise removable bridging strip. The purpose of the bridging strip is to space and hold apart (lock) the side wings in order to be able to stably store and (in particular) transport the plate. Only when the plate is to be folded, the bridging strip is removed, so that (the side wings of) the profile and the plate, in which the profile has been incorporated, can be folded.

Preferably, the side wings of the folding profile are provided with connecting means, which are arranged to detachably interconnect with each other, when the side wings are folded towards each other. Preferably the connecting means are mutually snap-connectable when the side wings are folded towards each other. Additionally, the profile is preferably arranged for co-operation with a filler strip which, if desired, is arranged to be fitted (inserted) between the side wings of the folding profile. The filler strip and the side wings of the folding profile are preferably provided with connecting means, which are arranged to detachably interconnect with each other, when the side wings and the filler strip are folded towards each other. Preferably, the connecting means are mutually snap-connectable when the side wings and the filler strip are folded towards each other.

The invention also comprises a filler strip, which is arranged to be fitted between the side wings of the folding profile, and preferably is provided with connecting means, which are arranged to detachably interconnect with the side wings of the folding profile, when the side wings and the filler strip are folded towards each other. Preferably the connecting means are snap-connectable when the side wings and the filler strip are folded towards each other.

The invention also comprises an assembly comprising a profile and a filler strip which are both described hereinbefore.

Thus, by means of a method as described hereinbefore, a building plate element is obtained, comprising a flat plate with at least one folding groove, having inserted therein a folding profile comprising, in cross-sectional view, two side wings and an interposed folding portion, wherein the side wings form a strong connection with both side faces of the folding groove and/or with the zones of the flat plate located adjacent to the folding groove. Preferably, in order to increase the stability of the plate during transport etc., the opening of the side wings is bridged by a bridging strip, which must be removed before the plate member is to be folded.

Further it is observed that the profile according to the invention offers protection for the corners, this includes the (invisible) inside of the cardboard layer of a gypsum board, or the plastic layer of other plates, such as chipboard.

Due to the invention, therefore, corners can be made on the construction site without glue, since the plates can be quickly and efficiently folded and locked in place. Due to the profile on the inside of the protective layer (cardboard, polystyrene or laminated layer) a good mechanical protection is offered against damage (which will become clear in more detail from the following description of the figures).

The system proposed by the invention is therefore quick and easy. No gluing is required, and it is also essential that the plate-shaped building elements, before they are installed, can be stored and transported in a flat state. The plates are not formed until arrival at the construction site. During storage and transport, the "folding openings" between the side wings (preferably) are closed/locked by a readily removable bridging or locking strip.

In the factory the folding groove is milled, after which—also in the factory—the folding profile is fitted (fixed) therein, for example glued. Furthermore is envisaged to manufacture a (limited) number of basic sizes, however, customization is also possible. So the plates arrive at the factory, where they are milled and provided with the folding profile, they subsequently leave the factory on the same pallet as on which they arrived, for example.

BRIEF DESCRIPTION OF THE SEVERAL VIEWS OF THE DRAWINGS

The invention will be hereinafter further explained by means of the description of the drawing.

DETAILED DESCRIPTION OF THE INVENTION

Figure 1:
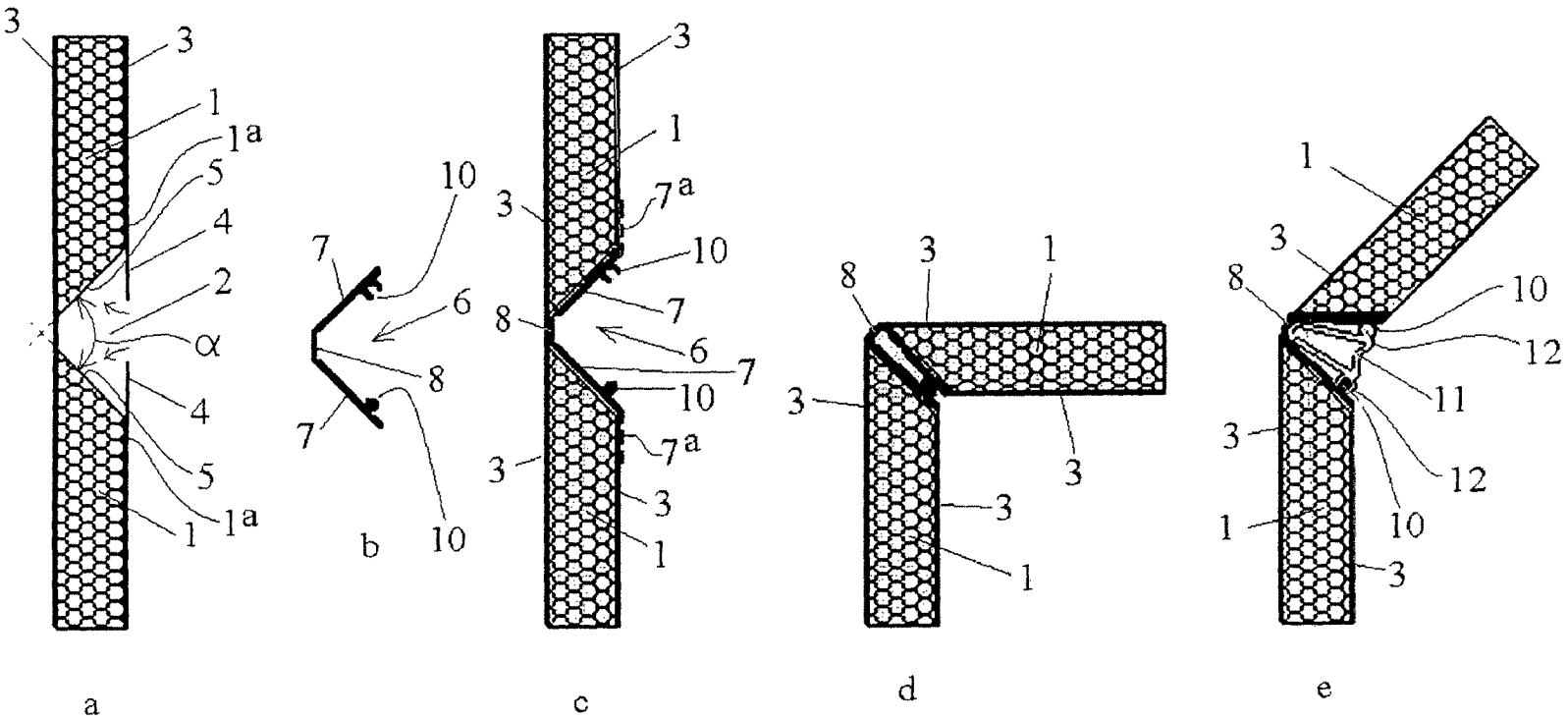
FIGS. 1*a-e* illustrate the method according to the invention and an example of an embodiment of the result thereof.

FIGS. 1*a-e* show schematically the method according to the invention for the manufacture of a foldable building plate element, comprising the steps of:

(see FIG. 1*a*) providing a flat plate 1 and providing, e.g. by means of milling or sawing, of a folding groove 2 into the flat plate 1. In particular, gypsum boards and other boards are envisaged, such as, for example, coated (e.g. plastic-coated) chipboard or plywood, which are (usually on both flat sides) provided with a protective layer 3. The folding groove 2 is so deep milled or sawed into the plate that it (just) does not extend through the opposite protective layer. Optionally, the projecting parts 4 of the protective layer 3 on the side of the folding groove 2 are folded interiorly onto the side faces 5 of the folding groove 2 and glued therein.

(see FIG. 1*b*) providing a folding profile 6, comprising, in cross-sectional view, two side wings 7, and a there between located folding portion 8;

(see FIG. 1*c*) fitting the folding profiles 6 into the folding groove 2 in such a way, that the side wings 7 form a strong connection with both sides faces 5 of the folding groove 2. Preferably, the side wings 7 and any (optional) extensions 7*a* as lengthening portions, are glued against the side faces of the folding groove and optionally against zones is located adjacent to the folding groove 2. The optional extensions 7*a* may optionally be attached slightly recessed into the flat plate 1 by providing a shallow recess into the flat plate 1—for example by milling—in the zones 1*a* adjacent to the folding groove 2. This ensures that the extensions 7*a* do not project outside the surface of the flat plate 1, so that the plates 1 can be stacked entirely flat, without being hampered by the material thickness of said extensions 7*a*. Moreover, the application of the extensions 7*a* is optional; they are in particular intended for the situation when the adhesion between the wings 7 and the side faces 5 would not be sufficient. In order to indicate that the extensions 7*a* are optional, they are shown in dotted lines, only in FIG. 1*c* of FIG. 1.

The side wings 7 of the folding profile 6 are provided with connecting means 10, which are arranged to be detachably interconnect with each other when the side wings 7 are folded towards each other. The connecting means 10 are preferably mutually snap-connectable (clickable) when the wings 7 are folded towards each other. In many cases the opening angle α, in cross-sectional view, of the folding groove is 90°; however if appropriate, the opening angle α may be chosen greater than or less than 90°.

The connecting means 10 may be a snap connection like a ball-and-socket arrangement or its equivalent or a click connection like a snap member with ends.

FIG. 1*c* shows the result of gluing the folding profiles 6 into the folding groove 2. In this way—of which FIG. 1*c* is an illustration—the plate elements are made in a factory—beforehand fully customized in size—and are transported in a flat state to the relevant construction site, and are folded only just there, during their installation, as is depicted in FIG. 1*d*.

FIG. 1*d* shows the same plate 1 as shown in FIG. 1*c*, however, now in the "bent" or folded over state, e.g. mounted having an angle of 90°. In order to provide a strong corner connection, the side wings 7 are moved towards each other—at the construction site—so that at the end of that movement the side wings 7 are coupled to each other with their snap connections 10.

When an angle other than 90° is desired, while the opening angle α of the folding groove is 90°, a filler strip 11 may be provided—as illustrated by FIG. 1—which is arranged to be fitted between the side wings 7 of the folding profile 6. The filler strip 11 and the side wings 7 of the folding profile 6 are provided with connecting means 10 (previously mentioned) and 12, which are arranged to be detachably interconnect with each other when the side wings 7 and the filler strip 11 are folded towards each other. The connecting means 10 and 12 are mutually snap-connectable when the side wings 7 and the filler strip 11 are folded towards each other, so that also here a robust corner connection is formed, corresponding to the embodiment where no filler strip 11 is used.

It should be noted that preferably the (remaining intact) protective layer 3 extends over the folding portion 8 on the side of the folding portion 8, so that the folding portion 8 is not visible from the outside, since it is located under the original protective layer 3 of the plate material.

The installation of a building plate element manufactured as described hereinbefore, and shown in FIGS. 1*a-e*, therefore comprises the following steps:

providing a building plate element as shown in FIG. 1*c;* folding the flat plate by means of the folding profile 6 or the folding profiles (for the purpose of a building element having more folds) into the desired form;

applying, if necessary, a filler strip 11 between the side wings 7 of the folding profiles 6.

FIGS. 2*a-e* show the same method as the FIGS. 1*a-e*, now however, use is being made of a folding profile with a bridging strip 9. The bridging strip 9 (preferably) is integral with the rest of the profile 6, which may be entirety (i.e. including the parts 7-10) manufactured by means of extrusion. The bridging strip 9 is connected to the ends of the side wings 7 by means of thin passage bodies 9*a*. As a result, the bridging strip 9, which closes and bridges the outspread side wings 7 during storage and transport, can be torn away with little effort from between the side wings 7, wherein the passage bodies 9*a* act as tear grooves. After the bridging strip 9 is removed (see arrow) the folding profile 6 is folded, and thereby the entire plate 1.

Figure 2:
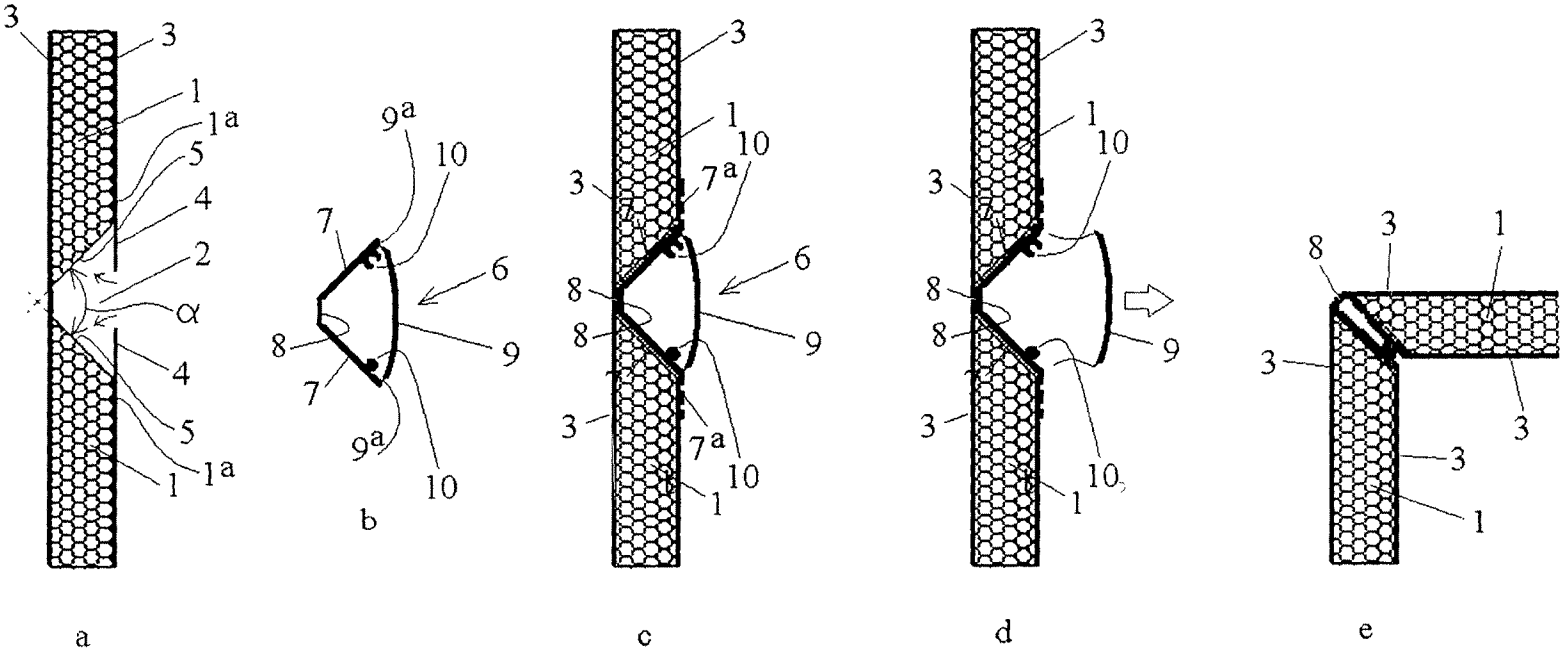
FIGS. 2*a-e* show the same method in which, however, use is made of a folding profile with a bridging strip.
Figure 3:
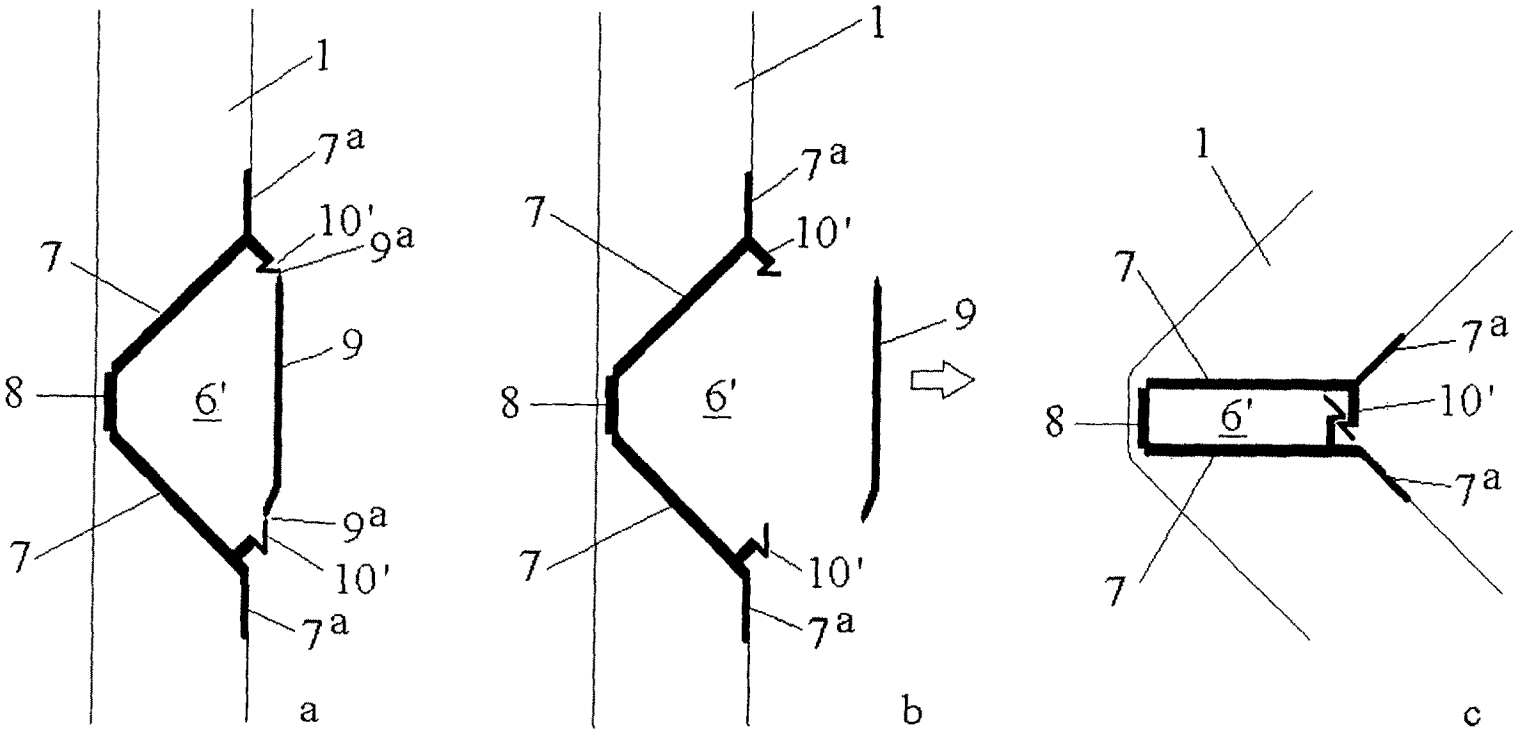
FIGS. 3*a-c* show schematically the method of the FIG. 2, by using an alternative folding profile.

FIGS. 3*a-c* show schematically the method of FIG. 2, but now by using an alternative folding profile 6. This folding profile 6 is intended to provide an improvement with regard to the dimensional stability of the profile, in particular of the "click connection". Returning to FIG. 2*b*, it is clearly shown there that the two parts 10, which form a snap connection, are located within a space that is bounded by the wings 7 and the bridging strip 9. When the profile 6 is manufactured by extrusion, that profile 6, after having been pressed out of the respective extruder head, is passed through a cooling bath, in which it is cooled. The profile shape shown in FIG. 2*b* may possibly have the disadvantage that the snap members 10 can not optimally be cooled down by the cooling bath, because they are located inside the profile shape and therefore can not be reached directly by the cooling liquid.

The profile 6', shown in FIGS. 3*a-c*, comprises snap-connectable parts 10', which in particular can be reached from the outside by the coolant of the cooling bath. Thereby is provided that the shape retention of the snap component 10' is improved with respect to the parts 10 in the previous Figures.

Figure 4:
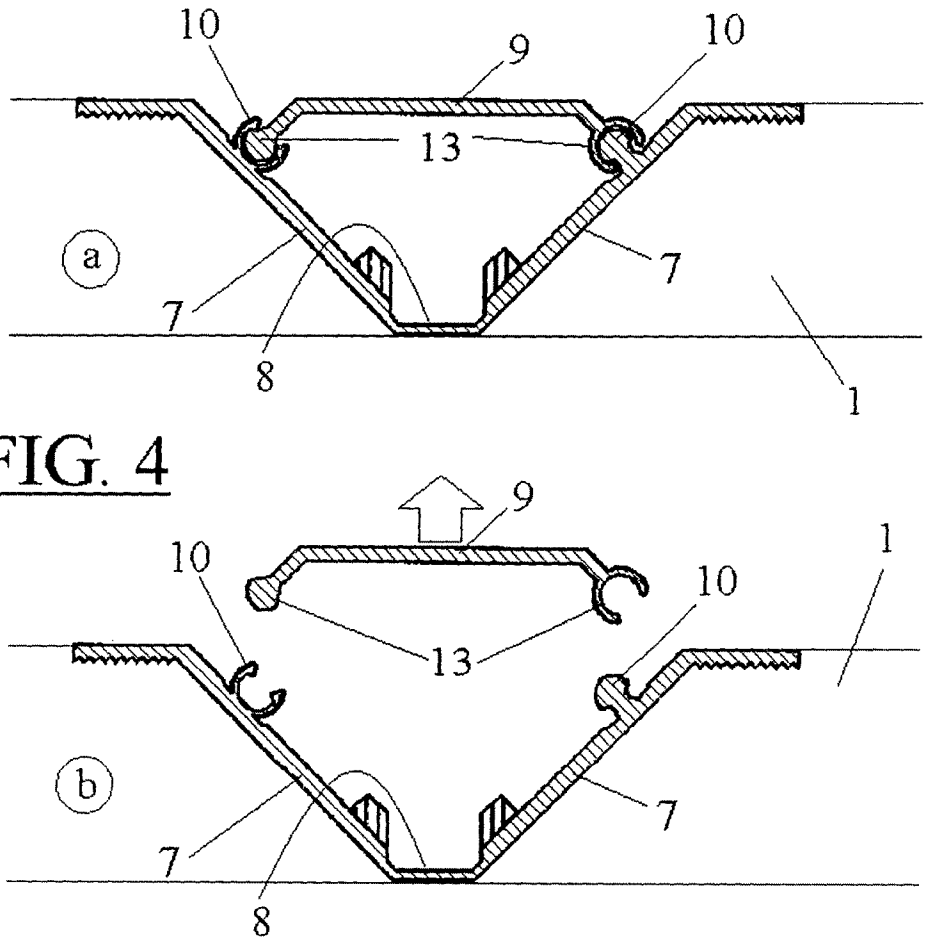
FIGS. 4*a-b* show a preferred embodiment of a bridging/locking profile, in combination with a folding profile as shown in FIG. 1*b-e*.

FIGS. 4*a-b* show a preferred embodiment of a bridging/locking profile or strip, in combination with a folding profile as shown in FIGS. 1*b-e*. In this embodiment the bridging strip 9 comprises snapped-together (FIG. 4*a*) and snapped-apart (FIG. 4*b*) connecting means 13, which co-operate with the connecting means 10 on the side wings 7 of the folding profile. The connecting means 13 on the bridging strip 9 are arranged to connect the bridging strip 9 to the side wings 7 of the folding profile, in the opened position of the side wings 7, as long as the plate member 1 is stored or transported. The bridging strip 9 is only then removed—by tearing or pulling the bridging strip 9 loose from the space between the side wings 7—when the plate member 1 is to be folded (wherein the side wings 7 move towards each other and are interconnected with each other by means of the connecting means 10, or—if desired—are connected to a filler strip 11 located between the side wings 7.

The invention claimed is:

1. A profile, arranged to be used as a folding profile, the profile comprising;

two side wings (7, 7*a*) and an interposed folding portion (8) in cross sectional view, wherein the side wings are arranged to form a strong connection with both side faces of a folding groove (2) and/or with zones of a flat plate (1) located adjacent to the folding groove;

wherein the side wings of the folding profile are provided with connecting means (10), which are arranged to detachably interconnect, when the side wings are folded towards each other;

wherein the connecting means (10) on the side wings are mutually snap-connectable when the side wines are folded towards each other;

wherein during transport or storage of the flat plate (1) the side wings of the folding profile are interconnected by means of a removable bridging strip (9) to maintain the folding profile in an open position, the bridging strip (9) comprises connecting means (13), the connecting means (13) on the bridging strip are snap-connectable and snap-detachable, wherein the connecting means (13) on the bridging strip (9) are the same as the connecting means (10) on the side wings of the folding profile, so that in the open position of the side wings, the snap-connectable means (13) of the bridging strip are snap-connected to the snap-connectable means (10) on both side wings of the profile.

2. The profile according to claim 1, further comprising a filler strip (11) arranged to be fitted between the side wings of the folding profile, after the bridging strip is removed;

wherein filler strip connecting means (12) are snap-connectable and snap-detachable, wherein the filler strip connecting means (12) are the same as the connecting means (10) on the side wings (7, 7*a*) of the folding profile, so that in the folded position of the side wines, the filler strip snap-connectable means (12) are snap-connected to the snap-connectable means (10) on both side wings of the profile.

* * * * *